US007922555B2

(12) United States Patent
Nishinaka et al.

(10) Patent No.: US 7,922,555 B2
(45) Date of Patent: Apr. 12, 2011

(54) METHOD OF MANUFACTURING PLASMA DISPLAY PANEL

(75) Inventors: Masaki Nishinaka, Osaka (JP); Akinobu Miyazaki, Osaka (JP)

(73) Assignee: Panasonic Corporation, Osaka (JP)

( * ) Notice: Subject to any disclaimer, the term of this patent is extended or adjusted under 35 U.S.C. 154(b) by 308 days.

(21) Appl. No.: 11/816,004

(22) PCT Filed: Feb. 23, 2007

(86) PCT No.: PCT/JP2007/053350

§ 371 (c)(1),
(2), (4) Date: Aug. 10, 2007

(87) PCT Pub. No.: WO2007/099864

PCT Pub. Date: Sep. 7, 2007

(65) Prior Publication Data

US 2010/0130090 A1 May 27, 2010

(30) Foreign Application Priority Data

Feb. 28, 2006 (JP) ..... 2006-051745

(51) Int. Cl.
*H01J 17/49* (2006.01)

(52) U.S. Cl. ..... 445/25; 313/582

(58) Field of Classification Search ..... 445/24–25; 313/582–587

See application file for complete search history.

(56) References Cited

U.S. PATENT DOCUMENTS

| | | | |
|---|---|---|---|
| 6,873,389 | B2 | 3/2005 | Ikeya et al. |
| 2003/0227252 | A1 | 12/2003 | Ikeya et al. |

FOREIGN PATENT DOCUMENTS

| | | | | |
|---|---|---|---|---|
| EP | 1496025 | A1 | | 1/2005 |
| JP | 2001-253724 | A | | 9/2001 |
| JP | 2003-095697 | | | 4/2003 |
| JP | 2003-115266 | | | 4/2003 |
| JP | 2003-115266 | A | | 4/2003 |
| JP | 2003095697 | A | * | 4/2003 |
| JP | 2004-014332 | | | 1/2004 |
| JP | 2004-014332 | A | | 1/2004 |
| JP | 2004-182584 | | | 7/2004 |
| JP | 2005-052208 | | | 3/2005 |
| JP | 2005-093206 | | | 4/2005 |
| WO | WO 2005/073142 | | | 8/2005 |
| WO | WO 2005/073142 | A1 | | 8/2005 |

OTHER PUBLICATIONS

English translation of JP2003-095697A.*
Supplementary European Search Report for Application No. EP 07 71 4821., Mar. 26, 2010, Panasonic Corporation.
Japanese Search Report for Application No. PCT/JP2007/053350 dated May 1, 2007.
English translation of Form PCT/ISA/210.

* cited by examiner

*Primary Examiner* — Anne M Hines
(74) *Attorney, Agent, or Firm* — RatnerPrestia

(57) ABSTRACT

A method for manufacturing a PDP equipped with an exhaust tube (21) for evacuating a discharge space formed by arranging a front plate (22) and a back plate (23) oppositely and sealing the circumferential edge portions of the front plate and the back plate by sealant (31) and then filling the discharge space with discharge gas, the method comprising steps for arranging the sealing side of the exhaust tube around a thin exhaust hole (30) provided in the back plate through a tablet (32) formed of frit glass not containing sealing lead but containing bismuth oxide, assembling the front plate and the back plate while arranging them oppositely, mounting the exhaust pipe on an exhauster while directing the side connected with the exhauster downward, and performing the sealing at a predetermined sealing temperature.

3 Claims, 4 Drawing Sheets

METHOD OF MANUFACTURING PLASMA DISPLAY PANEL

This application is a U.S. National Phase Application of PCT International Application PCT/JP2007/053350.

TECHNICAL FIELD

The present invention relates to a method of manufacturing a plasma display panel (hereinafter, abbreviated as a "PDP"), which is a flat-panel display device used for a large scale television set, a display in public places or the like, and more specifically, relates a method of manufacturing a PDP that has an exhaust pipe for exhausting a discharge space formed in the PDP and filling the space with a discharge gas.

BACKGROUND ART

The PDPs can be implemented as high-resolution and large-size displays, and therefore, have been commercialized as television sets having a diagonal screen of 65 inches or large-scale displays in public places, and are even planned to be commercialized as the devices having a diagonal screen of over 100 inches. In particular, the PDPs used for TV sets are going to be applied to the Full High Definition TVs, which have twice or more number of scanning lines than the conventional NTSC TVs.

The PDP is basically composed of a front panel and a rear panel. The front panel is composed of a glass substrate made of float-processed sodium borosilicate glass. Display electrodes composed of transparent electrodes and bus electrodes having a stripe form are disposed on one major surface of the glass substrate. A dielectric layer covering the display electrodes is formed so as to function as a capacitor. A protecting layer made of magnesium oxide (MgO) is formed on the dielectric layer. On the other hand, the rear panel is composed of another glass substrate provided with a fine hole for exhausting an air and filling (also referred to as "introducing") a discharge gas. On one major surface of the another glass substrate, address electrodes (also referred to as "data electrodes") are arranged in a stripe form. An underlying dielectric layer is formed so as to cover the address electrodes. Barrier ribs are formed on the underlying dielectric layer. Phosphor layers for respectively generating visible light of red, green and blue colors are formed between the adjacent barrier ribs.

The front and rear panels are placed so that the major surfaces thereof provided with the electrodes thereon face each other. The peripherals of the front panel and the rear panel, and an exhaust pipe for exhausting an air and filling a discharge gas are sealed in airtight with adhesives. The discharge space divided by the barrier ribs is once exhausted and then filled with the discharge gas (at a pressure of 400 Torr to 600 Torr for Ne—Xe gas) via the exhaust pipe, and thereafter, sealed in airtight by locally heating and melting (i.e., chipping off) an adequate portion of the exhaust pipe. An image signal voltage is selectively applied to the display electrodes in the completed PDP to thereby cause discharge that generates ultraviolet light. The ultraviolet light excites respective phosphor layers to generate visible light of red, green and blue colors. Thus, the PDP implements a color image display.

Low-melting glass (also referred to as "frit glass"), which generally contains lead oxide as a major constituent, is used as the adhesive that is used for sealing the dielectric layer, the peripherals of the front and rear panels, and the exhaust pipe in the above-stated PDP. The frit glass includes amorphous frit glass and crystalline frit glass. The amorphous one is not crystallized but keeps amorphous characteristics even when heated, whereas the crystalline one is crystallized when heated. Those two materials each have both advantages and disadvantages, and therefore, are selected for use in consideration of suitability for the manufacturing steps. A pasty adhesive formed by kneading the mixture of the frit glass and filler with organic solvent is used to seal the peripheries of the front and rear panels. First, the adhesive is placed at a specified position in the periphery of at least one of the front and rear panels by use of a thick film printer or a coater provided with an ink jet or a dispenser. Next, preliminary firing is performed at such a specified temperature in advance that the frit glass is not melted (or not softened), before the front and rear panels are positioned to face each other and assembled.

To seal the exhaust pipe, material formed by kneading the mixture of the frit glass and filler with organic solvent is first prepared, like in sealing the peripheries of the front and rear panels. Next, the material is molded into a form having a through-hole 233 at the center portion thereof by use of a mold, as shown in the perspective view of FIG. 5. The molded material is then fired at such a temperature that the solvent is evaporated; thereby a sintered adhesive referred to as tablet 232 is obtained. Tablet 232 is used for sealing the exhaust pipe.

Environmental concerns of recent years require non-lead material, which contains no lead and is called "lead-free" or "lead-less", to be used also for the PDP. As examples of the adhesive, a lead-free phosphate (such as phosphate-tin oxide) adhesive and a bismuth oxide adhesive are disclosed (e.g., in Patent Document 1, and Patent Document 2). The adhesive that contains, as a major constituent, phosphate-tin oxide low-melting glass, which has been proposed as the non-lead adhesive, is lower in water resistance than a lead oxide adhesive, which has conventionally been used. This results in a problem that the PDP hardly maintains sufficiently high airtightness, and therefore, a bismuth oxide adhesive is noticed as non-lead material. The non-lead adhesive that contains bismuth oxide frit glass as a major constituent is characterized by crystallization during firing, and is known to incline higher in softening point than lead-containing ordinary amorphous frit glass. Lead-containing borosilicate glass has been used for the conventional exhaust pipe due to its relatively low softening point and high working efficiency at the sealing step, whereas it is now being replaced with non-lead borosilicate glass because of environmental consideration.

FIGS. 6A and 6B are each a schematic cross-sectional view showing a procedure of sealing the peripheries of front panel 222 and rear panel 223 and exhaust pipe 221 with adhesives 231*a* and 231*b*. With reference to FIG. 6A, first, adhesive 231*a* or 231*b* is applied to a specified portion of the periphery of at least one of front panel 222 and rear panel 223 by use of a thick film printer or a coater provided with an ink jet or a dispenser. Front panel 222 and rear panel 223 are positioned on each other so that the display electrodes on front panel 222 and data electrodes on rear panel 223 intersect at a right angle and are aligned at a specified position with each other. Front panel 222 and rear panel 223 are then fixed with each other with a fastening tool (not shown). Next, tablet 232 is mounted on rear panel 223 so that the center of through hole 233 formed at the center portion of tablet 232 coincides with the center of fine exhaust hole 230 disposed at a specified position around the corner of rear panel 223. Exhaust pipe 221 is positioned on tablet 232 so that the center of one open end of exhaust pipe 221 substantially coincides with the center of fine exhaust hole 230, and is assembled and fixed with rear panel 223 and tablet 232 with another fastening tool (not shown) so as to prevent the centers from being displaced.

Finally, the respective adhesives, which are applied to front panel 222, rear panel 223 and exhaust pipe 221 assembled and fixed with each other with the fastening tools, are heated to melt, and thereafter are cooled down to solidify. Thus, the sealing process has been performed.

FIG. 6A shows an arrangement where the open end of exhaust pipe 221 to be sealed is at a lower side and the other open end thereof to be connected with an exhaust device is at a higher side. In this arrangement, a connecting pipe for connecting exhaust pipe 221 with the exhaust device has to be long and bent. Therefore, another arrangement, where exhaust pipe 221 is placed up side down from that shown in FIG. 6A, has been used in some cases. Specifically, the arrangement shown in FIG. 6B, where the open end of exhaust pipe 221 to be connected with the exhaust device faces down, is used for the sealing process in some cases. The arrangement shown in FIG. 6B allows exhaust pipe 221 to easily and directly be connected with the exhaust device, and therefore, allows exhaust pipe 221 to be shortened and an exhaust period to be reduced advantageously.

The sealing process performed by using the arrangement shown in FIG. 6B, where the open end of the exhaust pipe to be connected with the exhaust device faces down, well prevents the softened (or melted) adhesive from dripping, if tablet 232 is formed of an adhesive mainly made of lead-containing frit glass.

However, the sealing process performed by using the same arrangement, sometimes causes dripping of the adhesive during the sealing step, if the tablet is formed of an adhesive mainly made of non-lead frit glass. The dripping of the adhesive deteriorates airtightness at the sealed portion of the exhaust pipe, and has thereby prevented a reliable sealing.

Patent Document 1: Unexamined Japanese Patent Publication No. 2004-182584,

Patent Document 2: Unexamined Japanese Patent Publication No. 2003-095697

DISCLOSURE OF THE INVENTION

One aspect of the present invention is directed to a method of manufacturing a plasma display panel. The plasma display panel includes: a front panel and a rear panel positioned to face each other sealed with an adhesive at peripheries of the front panel and the rear panel to form a discharge space therein; and an exhaust pipe for once exhausting the discharge space and then filling the discharge space with a discharge gas. The method includes steps of: placing a first open end of the exhaust pipe to be sealed around a fine exhaust hole disposed on the rear panel via a tablet formed of non-lead frit glass containing bismuth oxide; positioning and assembling the front panel and the rear panel facing with each other; placing a second open end of the exhaust pipe to be connected with an exhaust device on the exhaust device with the second open end facing down; and performing a sealing at a specified sealing temperature. The method of manufacturing a PDP in accordance with the present invention can also employ a method where bismuth oxide-boron oxide frit glass is used for the tablet, and can further employ a method where the frit glass used for the tablet has a softening point 10° C. higher than a the adhesive used for sealing the peripheries of the front panel and the rear panel.

The method allows a sealing process to be performed without dripping of the softened (melted) frit glass at a sealing temperature even if the frit glass is non-lead, therefore prevents the deterioration in airtightness at the sealed portion, and provides PDPs that are environment-friendly and high in quality and reliability.

EXPLANATIONS OF LETTERS OR NUMERALS

Figure 1:
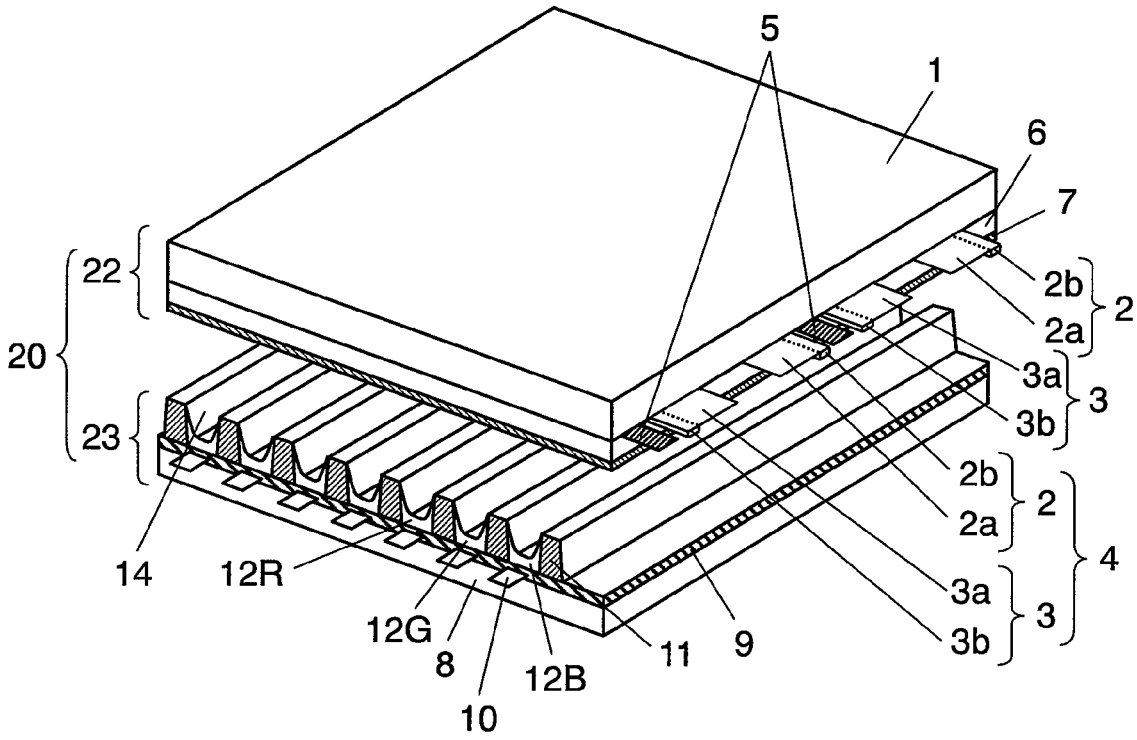
FIG. 1 is a perspective view showing a structure of a PDP in accordance with a preferred embodiment of the present invention.

1 front glass substrate
2 scan electrode
2*a*, 3*a* transparent electrode
2*b*, 3*b* metal bus electrode
3 sustain electrode
4 display electrode
5 black stripe (shielding layer)
6 dielectric layer
7 protecting layer
8 rear glass substrate
9 underlying dielectric layer
10 address electrode (data electrode)
11 barrier rib
12R, 12G, 12B phosphor layer
14 discharge space (discharge cell)
20 PDP
21 exhaust pipe
22 front panel
23 rear panel
30 fine exhaust hole
31, 31*a*, 31*b* adhesive
32 tablet
33 through hole
41 exhaust pipe head
42 elastic member

PREFERRED EMBODIMENTS FOR CARRYING OUT OF THE INVENTION

Now, preferred embodiments of the present invention will be described in detail with reference to accompanying figures.

First Preferred Embodiment

FIG. 1 is a perspective view showing a structure of PDP 20 in accordance with the preferred embodiment of the present invention. PDP 20 is identical in basic structure with a general AC surface discharge PDP. As shown in FIG. 1, PDP 20 includes front panel 22 and rear panel 23 that are positioned to face each other. Front panel 22 includes front glass substrate 1; rear panel 23 includes rear glass substrate 8. The peripheries of the panels are airtightly sealed by use of an adhesive composed of grass frit or the like. Discharge space 14 defined inside sealed PDP 20 is filled with a discharge gas, such as neon (Ne), xenon (Xe) or the like, at a pressure of 400 Torr to 600 Torr.

On front glass substrate 1 of front panel 22, plural pairs of stripe-shaped display electrodes 4 and a plurality of black stripes (i.e., shielding layers, and abbreviated as "BS" in some cases) 5 are alternately arranged in parallel. Each pair of display electrodes 4 includes scan electrode 2 and sustain electrode 3. Dielectric layer 6 is formed on front glass substrate 1 so as to cover display electrodes 4 and shielding layers 5 and to function as a capacitor. Protecting layer 7, made of magnesium oxide (MgO) or the like, is formed on the surface of dielectric layer 6.

On rear glass substrate 8 of rear panel 23, a plurality of stripe-shaped address electrodes 10 are arranged in parallel with each other and in a direction intersecting scan electrodes 2 and sustain electrodes 3 on front panel 22 at a right angle. Underlying dielectric layer 9 covers address electrodes 10. On underlying dielectric layers 9, barrier ribs 11 are formed between address electrodes 10 at such a specified height as to divide discharge space 14. In grooves between adjacent barrier ribs 11, phosphor layers 12R, 12G and 12B are formed by coating alternately. Respective phosphor layers 12R, 12G and 12B are arranged over address electrodes 10 in a one-to-one correspondence. Phosphor layers 12R, 12G and 12B emit visible light of red, green and blue colors by receiving an ultraviolet ray, respectively. Discharge spaces (also referred to as "discharge cells") 14 are formed at intersections of scan electrodes 2 and sustain electrodes 3 with address electrodes 10. Each discharge cell 14, which includes phosphor layers 12R, 12G and 12B respectively responsible for red, green and blue colors arranged in a direction of display electrodes 4, functions as a pixel for color display.

Next, a method of manufacturing PDP 20 will be described. First, scan electrodes 2, sustain electrodes 3 and shielding layers 5 are formed on front glass substrate 1. Transparent electrodes 2*a*, 3*a* and metal bus electrodes 2*b*, 3*b* are patterned by use of photolithography or the like to be formed. Transparent electrodes 2*a*, 3*a* are formed by use of thin film process or the like. Paste containing silver is fired at a specified temperature and thereby solidified to form metal bus electrodes 2*b*, 3*b*. Likewise, paste containing black colorant is screen-printed, or the black colorant is coated over the entire glass substrate and thereafter patterned by use of photolithography, and then firing is performed to form shielding layer 5.

Subsequently, dielectric paste is coated on front glass substrate 1 so as to cover scan electrodes 2, sustain electrodes 3 and shielding layers 5 by use of dyecoat or the like to form a dielectric paste layer (i.e. dielectric material layer). The dielectric paste is left for a certain period after being coated, and in consequence, the surface of the coated dielectric paste is leveled and flattened. Thereafter, the dielectric paste layer is fired and solidified to form dielectric layer 6 covering scan electrodes 2, sustain electrodes 3 and shielding layers 5. It is noted that the dielectric paste is coating material containing dielectric material, such as glass powder or the like, binder, and solvent. Next, protecting layer 7 made of magnesium oxide (MgO) is formed by vacuum deposition on dielectric layer 6. The foregoing steps forms a specified structure (i.e., display electrodes 4 composed of scan electrodes 2 and sustain electrodes 3, shielding layers 5, dielectric layer 6 and protecting layer 7) on front glass substrate 1 and completes front panel 22. It should be noted that lead-containing material is used for none of above-described components of front panel 22.

On the other hand, rear panel 23 is formed through the following process. On rear glass substrate 8, paste containing silver is screen-printed, a metal film is coated entirely and thereafter patterned by use of photolithography, or other method is applied to form material layers to be a structure for address electrodes 10. The material layers are fired at a specified temperature to form address electrodes 10.

Next, dielectric paste is coated on rear glass substrate 8, having address electrodes 10 already formed, by use of dyecoat or the like so as to cover address electrodes 10 to thereby form a dielectric paste layer. Thereafter, the dielectric paste layer is fired to form underlying dielectric layer 9. It is noted that the dielectric paste is coating material containing dielectric material, such as glass powder or the like, binder, and solvent.

Next, paste containing material of barrier ribs 11 for forming the same is coated on underlying dielectric layer 9, and thereafter, patterned in a predetermined shape to thereby form barrier rib material layers. Further, the barrier rib material layers are fired to form barrier ribs 11. Here, photolithography or sand blasting can be used to pattern the paste for barrier ribs 11 coated on underlying dielectric layer 9.

On rear glass substrate 8 having barrier ribs 11 already formed, phosphor paste containing phosphor material is coated on underlying dielectric layer 9 between adjacent barrier ribs 11 and on the side walls of barrier ribs 11. The coated phosphor paste is fired to thereby form phosphor layers 12R, 12G and 12B. The foregoing steps complete rear panel 23 having a specified components on rear glass substrate 8. It should be noted that lead-containing material is used for none of the above described components of rear panel 23 as well as front panel 22.

Subsequently, the process proceeds to steps of positioning front panel 22 and rear panel 23 with the respective electrodes-forming sides thereof facing each other and airtightly sealing the peripheries thereof and an exhaust pipe for exhausting an air and filling a discharge gas (generally called "tip tube," and may also be referred to as "tip tube" instead of "exhaust pipe") with adhesives.

At a step of sealing the peripheries of front panel 22 and rear panel 23 of PDP 20 with an adhesive in accordance with the preferred embodiment of the present invention, a pasty adhesive formed by kneading the mixture of low-melting frit glass containing no lead and specified filler with organic solvent is used. First, adhesives are placed and formed at specified portions the peripheries of front panel 22 and rear panel 23 by use of a thick film printer or a coater provided with an ink jet or a dispenser. Next, front panel 22 and rear panel 23 are positioned so as to face each other and are assembled. Thereafter, the panels are subjected to preliminary firing at such a specified temperature as for the frit glass not to be melted (or not to be softened). The filler, having heat resistance, is used to regulate the thermal expansion coefficient of the adhesive and to control the fluidity of the glass. For such filler, any one of or any combination of cordierite, forsterite, β-eucryptite, zircon, mullite, barium titanate, aluminum titanate, titanium oxide, molybdenum oxide, tin oxide, aluminum oxide, silica glass, and the like is preferably used. The adhesive may also be formed without a thick film printer nor a coater, but may instead be formed by the following method. Adhesives are formed on sheet-like bases at a specified thickness and form with an adhesivity; the formed adhesives are placed and bonded onto portions of front panel 22 and rear panel 23; front panel 22 and rear panel 23 are assembled; and a sealing is performed.

Figure 2:
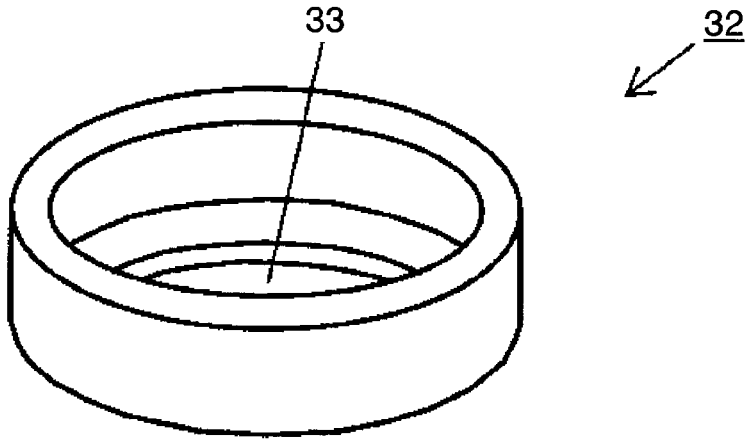
FIG. 2 is a perspective view showing an appearance of a tablet of the PDP in accordance with the preferred embodiment of the present invention.

On the other hand, at a sealing step of sealing the exhaust pipe of PDP 20 with an adhesive in accordance with the preferred embodiment of the present invention, material formed by kneading the mixture of non-lead frit glass and filler with solvent is prepared, similarly to at the step of sealing the peripherals of front panel 22 and rear panel 23. Next, the material is molded into a form having a through-hole 33 at the center portion thereof by use of a mold, as shown in FIG. 2. The molded material is then fired at such a temperature that the solvent is evaporated and thereby a sintered adhesive referred to as tablet 32 is obtained. Tablet 32 is used for sealing the exhaust pipe. The filler in tablet 32 to be used for the adhesive for sealing the exhaust pipe can be the same in material as the filler added to the aforementioned adhesive to be used for sealing the peripherals of the aforementioned front panel 22 and rear panel 23. Tablet 32 is also formed of frit glass containing no lead.

Figure 3A:
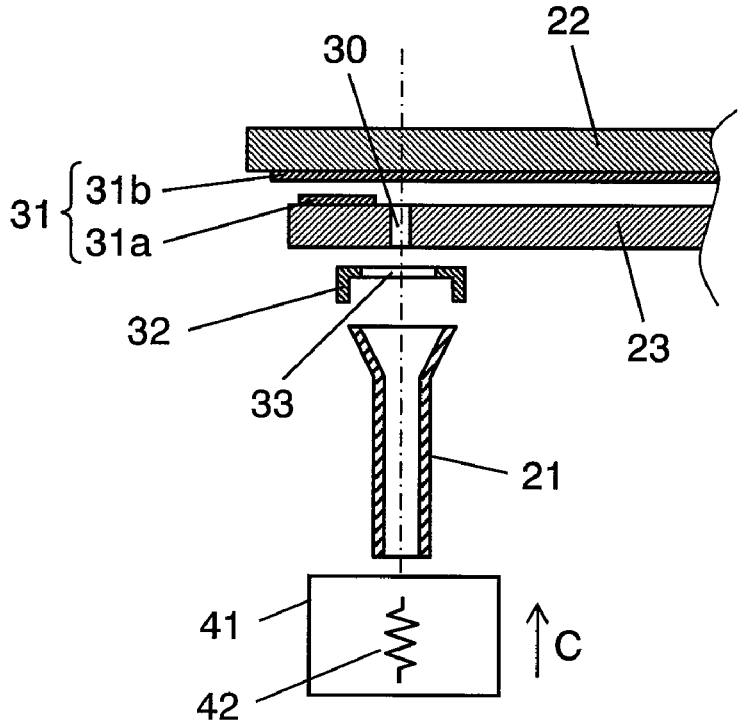
FIG. 3A is a cross-sectional view schematically showing a procedure of sealing the peripheries of a front panel and a rear panel and an exhaust pipe of the PDP with adhesives in accordance with the preferred embodiment of the present invention.
Figure 3B:
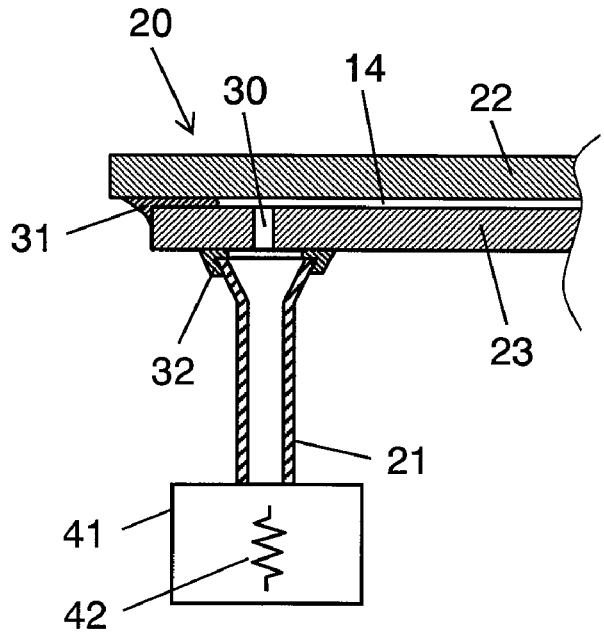
FIG. 3B is a cross-sectional view schematically showing a procedure of sealing the peripheries of a front panel and a rear panel and an exhaust pipe of the PDP with adhesives in accordance with the preferred embodiment of the present invention.

FIGS. 3A and 3B are each a cross-sectional view schematically showing a procedure of sealing the peripheries of front panel 22 and rear panel 23 and exhaust pipe 21 with adhesives 31. With reference to FIG. 3A, first, adhesives 31*a* and 31*b* are placed and formed at specified portions of the peripheries of front panel 22 and rear panel 23 by use of a thick film printer or a coater provided with an ink jet or a dispenser. Front panel 22 and rear panel 23 are positioned on each other so that the display electrodes 4 on front panel 22 and data electrodes 10 on rear panel 23 intersect at a right angle and are aligned with each other at a specified position. Front panel 22 and rear panel 23 are then fixed with each other with a fastening tool (not shown). Next, tablet 32 is mounted on rear panel 23 so that the center of through hole 33 formed at the center portion of tablet 32 coincides with the center of fine exhaust hole 30 disposed at a specified position around the corner of rear panel 23. Exhaust pipe 21 is positioned on tablet 32 so that the center of one open end of exhaust pipe 21 substantially coincides with the center of fine exhaust hole 30, and is assembled and fixed with rear panel 23 and tablet 32 with another fastening tool (not shown) so as to prevent the centers from being displaced. The method of manufacturing PDP 20 in accordance with the preferred embodiment of the present invention performs the sealing step, with the arrangement where one open end of exhaust pipe 21 to be sealed is placed at the upper side and the other open end to be connected with the exhaust device is at the lower side. This is because the arrangement allows exhaust pipe 21 to easily and directly be connected with the exhaust device, and therefore, allows exhaust pipe 21 to be shortened and process steps to be expected reduced.

Finally, after adhesives 31*a* and 31*b*, and tablet 32 are placed, and front panel 22, rear panel 23 and exhaust pipe 21 are assembled and fixed with the fastening tool, the lower open end of exhaust pipe 21 to be connected with the exhaust device is connected with exhaust pipe head 41. Exhaust pipe head 41 is provided with elastic member 42, such as a spring, and thereby capable of pressing exhaust pipe 21 in the direction shown by arrow C in FIG. 3A. Front panel 22, rear panel 23 and exhaust pipe 21, which have been assembled and fixed with the fastening tool, are placed into a firing furnace. After being preliminarily fired at a lower temperature than a sealing temperature for adhesive 31, adhesives 31*a* and 31*b* and tablet 32 are heated up to the temperature over the preliminary firing temperature so as to melt at the peripheries of front panel 22 and rear panel 23, and at the open end of exhaust pipe 21 facing rear panel 23. Thereafter, adhesives 31*a* and 31*b* and tablet 32 are cooled down to solidify and perform a sealing. FIG. 3B schematically shows the peripheries of front panel 22 and rear panel 23 and the open end of exhaust pipe 21 facing rear panel 23 being sealed.

Figure 4A:
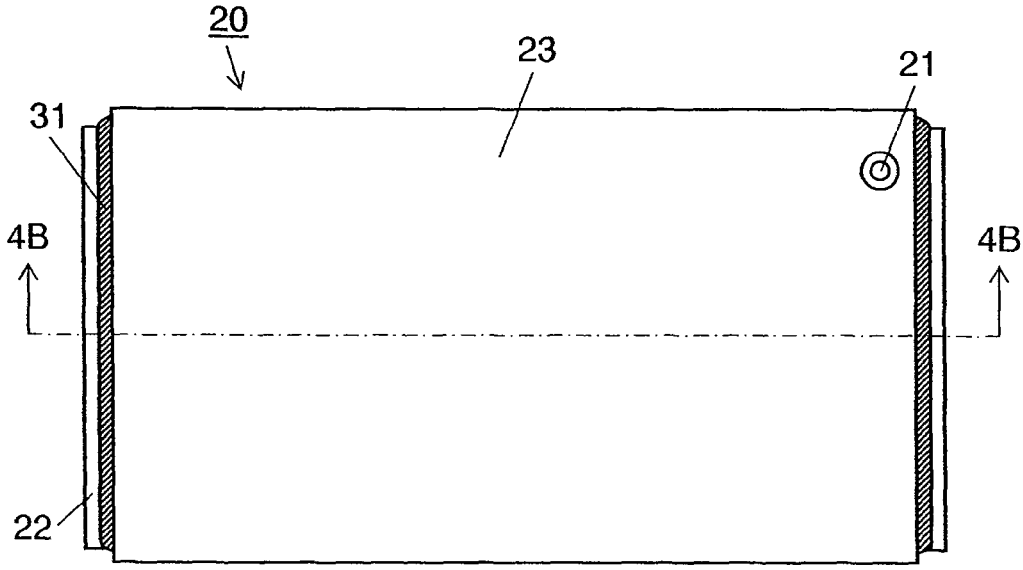
FIG. 4A is a plan view showing the PDP in accordance with the preferred embodiment of the present invention.
Figure 4B:
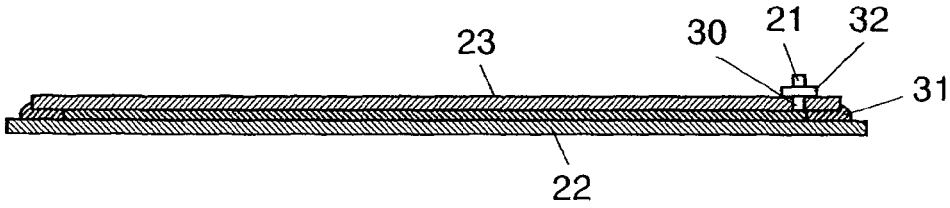
FIG. 4B is a cross-sectional view showing the PDP in accordance with the preferred embodiment of the present invention.
Figure 5:
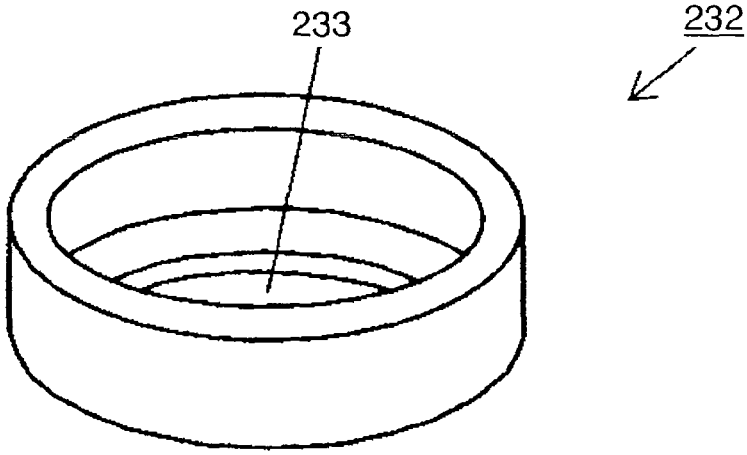
PRIOR ART FIG. 5
FIG. 5 is a perspective view showing an appearance of a tablet of a PDP in accordance with a conventional technique.

FIGS. 4A and 4B show front panel 22 and rear panel 23 of PDP 20 bonded and sealed with each other according to the preferred embodiment of the present invention. FIG. 4A is a plan view of PDP 20 according to the preferred embodiment of the present invention. FIG. 4B is a cross-sectional view showing PDP 20 taken from arrow 4B of FIG. 4A. FIGS. 4A and 4B show a structure having front panel 22 and rear panel 23 sealed with adhesive 31 at the peripheries thereof and having exhaust pipe 21 provided on rear panel 23.

As shown in FIGS. 4A and 4B, front panel 22 and rear panel 23 are positioned to face each other so as for display electrodes 4 and address electrodes 10 to intersect each other at a right angle. The peripheries of front panel 22 and rear panel 23, and the periphery of the widened open end of exhaust pipe 21 so positioned as to cover fine exhaust hole 30 disposed at a specified position around the corner of rear panel 23 are sealed with adhesive 31 composed of glass frit or the like. Subsequently, discharge space 14 divided by barrier ribs 11 is once exhausted of air to a vacuum via exhaust pipe 21 and then filled with a discharge gas containing Ne, Xe or the like at a specified pressure (e.g., 400 Torr to 600 Torr for Ne—Xe mixed gas) via exhaust pipe 21. The exhaust pipe 21 is then locally heated to be melted at an adequate portion (i.e., chipped off), being thereby sealed off. Thus, PDP 21, sealed airtightly, is completed. Tablet 32, formed of fired adhesive 31 and having a through-hole 33 at the center portion thereof as described above, is used to seal exhaust pipe 21.

To seal off exhaust pipe 21, a local heat sealing method, using a fixed gas burner, an electric heater or the like, is employed. An electric heat sealing method using the electric heater advantageously allows a heating temperature to be controlled relatively in accurate, and facilitates handling in mass-production and automatization thereof. The electric heat sealing method, however, needs a larger heater (i.e., the electric heater) than the method using the fixed gas burner, takes a long time for heating and cooling, and therefore, prevents a production tact time from being shortened. Accordingly, the sealing of exhaust pipe 21 is performed by use of the fixed gas burner in the preferred embodiment of the present invention. The step of sealing exhaust pipe 21 of PDP 20 in accordance with the preferred embodiment of the present invention is performed by the procedures of heating, melting and chipping off the portion of fixed exhaust pipe 21 to be sealed.

An image signal voltage is selectively applied to the display electrodes 4 in the completed PDP 20 to thereby cause discharge that generates ultraviolet light. The ultraviolet light excites phosphor layers 12R, 12G and 12B to generate visible light of red, green and blue colors, respectively. Thus, the PDP 20 implements a color image display.

Now, adhesive 31 and sealing method for PDP 20 in accordance with the preferred embodiment of the present invention will be described in more detail. First, pasty adhesive composition is coated on a periphery of one of front panel 22 and rear panel 23. The pasty adhesive composition contains non-lead borosilicate amorphous frit glass at least containing bismuth oxide ($Bi_2O_3$), heat resistive filler, and organic binder. A coater provided with a dispenser is used in the preferred embodiment of the present invention, whereas a thick film printer or an ink jet coater may also be used for the coating. After being dried for a certain period, the adhesive composition is subjected to preliminary firing at a specified temperature lower than the sealing temperature to thereby remove organic binder thereof. Material similar to adhesive 31, which is used to seal the peripheries of front panel 22 and rear panel 23, is used to seal the periphery of the widened open end of the exhaust pipe 21 so positioned as to cover fine exhaust hole 30 disposed at a specified position around the corner of rear panel 23. Specifically, material formed by kneading non-lead borosilicate amorphous frit glass at least containing bismuth oxide ($Bi_2O_3$), heat resistive filler, and solvent containing organic binder is used. The material is molded into a form having through-hole 33 at the center portion thereof by use of a mold, and is then fired at such a temperature that the solvent is evaporated. As a result, a sintered adhesive referred to as tablet 32 is obtained. Tablet 32 is used for sealing the exhaust pipe 21.

Thereafter, with a structure shown in FIG. 1, the substrates of front panel 22 and rear panel 23 are positioned to face each other so as for display electrodes 4 on front panel 22 and address electrodes 10 on rear panel 23 to intersect each other at a right angle. With a structure shown in FIGS. 3A and 3B, tablet 32 is positioned so as to cover fine exhaust hole 30 disposed at a specified position around the corner of rear panel 23. Then the widened open end of exhaust pipe 21 is positioned. Next, the structure is subjected to firing at a sealing temperature of 490° C. to 500° C. to thereby soften (or melt) the frit glass of adhesive 31 and tablet 32. Thereafter, the structure is cooled down to solidify adhesive 31 and tablet 32.

IWF BNL189P-200 (name of a product from Asahi Technoglass Corporation, and hereinafter abbreviated as "BNL189P"), which is non-lead borosilicate amorphous frit glass containing bismuth oxide ($Bi_2O_3$), is used for adhesive 31 applied for sealing the peripheries of front panel 22 and rear panel 23, in the process of manufacturing PDP 20 in accordance with the preferred embodiment of the present invention. BNL189P used here, which is non-lead borosilicate amorphous frit glass containing bismuth oxide ($Bi_2O_3$), has a composition of bismuth oxide ($Bi_2O_3$) of 70 weight % to 75 weight %, zinc oxide (ZnO) of 8 weight % to 10 weight %, boron oxide ($B_2O_3$) of 4 weight % to 6 weight %, aluminum oxide ($Al_2O_3$) of 6 weight % to 8 weight %, silicon oxide ($SiO_2$) and magnesium oxide (MgO) of 1 weight % to 3 weight %. Too small amount of bismuth oxide ($Bi_2O_3$) particularly prevents the glass from reducing its softening point and thereby prevents successful sealing with the glass. Too large amount thereof, on contrary, likely causes a reaction with silver (Ag) contained in display electrodes 4 and address electrodes 10 to form foam. Therefore, the amount of bismuth oxide is set within 70 weight % to 75 weight % in the preferred embodiment. However, the amount thereof within 65 weight % to 80 weight % is also preferable. Above-described BNL189P, which is non-lead borosilicate amorphous frit glass containing bismuth oxide ($Bi_2O_3$), exhibits a desirable glass softening point lower than 440° C.

IWF BNL188P-200 (name of a product from Asahi Technoglass Corporation, and hereinafter abbreviated as "BNL188P"), which is non-lead borosilicate amorphous frit glass containing bismuth oxide ($Bi_2O_3$), is used for tablet 32 as adhesive 31 applied for sealing rear panel 23 and exhaust pipe 21, in the process of manufacturing PDP 20 in accordance with the preferred embodiment of the present invention. BNL188P used here, which is non-lead borosilicate amorphous frit glass containing bismuth oxide ($Bi_2O_3$), has substantially the same composition as BNL189P. BNL188P, which is non-lead borosilicate amorphous frit glass containing bismuth oxide ($Bi_2O_3$) as described above, exhibits a desirable glass softening point lower than 450° C.

Table 1 shows representative characteristics of BNL189P, BNL188P, and GA-0963/200M (name of a product from Nippon Electric Glass Co., Ltd., and hereinafter abbreviated as "GA-0963"). BNL189P is non-lead borosilicate amorphous frit glass containing bismuth oxide ($Bi_2O_3$), and used for adhesive 31 applied to the peripheries of front panel 22 and rear panel 23 in the process of manufacturing PDP 20 in accordance with the preferred embodiment of the present invention. BNL188P is non-lead borosilicate amorphous frit glass containing bismuth oxide ($Bi_2O_3$), and used for tablet 32 for sealing rear panel 23 and exhaust pipe 21 in the process of manufacturing PDP 20 in accordance with the preferred embodiment of the present invention. GA-0963 is conventional lead-containing amorphous high-softening-point frit glass, and is shown for comparison.

TABLE 1

| Characteristics | Lead-containing high-softening point frit GA-0963/200M | Non-lead frit IWF BNL189P-200 | Non-lead tablet material IWF BNL188P-200 |
|---|---|---|---|
| Density | 6.4 g/cm$^3$ | 6.0 g/cm$^3$ | 6.0 g/cm$^3$ |
| Transition point | 365 ± 7° C. | 358 ± 5° C. | 364 ± 5° C. |
| Softening point | 440 + 10/−5° C. | 430 ± 5° C. | 439 ± 5° C. |
| Deformation point | 395 ± 7° C. | 408 ± 10° C. | 412 ± 10° C. |
| Thermal expansion coefficient | $67.3 \pm 1.5 \times 10^{-7}$ | $67.0 \pm 2.0 \times 10^{-7}$ | $67.0 \pm 2.0 \times 10^{-7}$ |

An experimental test has been performed, where exhaust pipe 21 is sealed by use of the tablet having a form shown in FIG. 2 with the arrangement shown FIGS. 3A and 3B, i.e., with the open end of exhaust pipe 21 to be connected with the exhaust device facing down. The tablet is formed of: GA-0963, which is lead-containing high-softening-point amorphous frit glass; and BNL188P, which is non-lead amorphous fit glass containing bismuth oxide ($Bi_2O_3$) for tablet use, among adhesives 31 mainly composed of frit glass shown in Table 1. The tablet is further formed of: non-lead amorphous phosphate-tin oxide frit glass: and non-lead amorphous vanadium oxide-zinc oxide-barium oxide frit glass, none of which are shown in Table 1. As a result, the lead-containing amorphous high-softening-point frit glass GA-0963, and the bismuth oxide ($Bi_2O_3$)-containing non-lead amorphous frit glass for tablet use BNL188P have been found to cause no dripping of adhesive 31. On the contrary, the phosphate-tin oxide and vanadium oxide-zinc oxide-barium oxide non-lead amorphous frit glasses have been found to cause the dripping of adhesive 31.

Non-lead amorphous frit glass is generally known to cause the dripping. The bismuth oxide ($Bi_2O_3$)-containing non-lead amorphous frit glass for tablet use BNL188P has, however, been revealed to cause no dripping. As described above, the phosphate-tin oxide and vanadium oxide-zinc oxide-barium oxide non-lead amorphous frit glasses cause the dripping of adhesive 31, whereas the bismuth oxide ($Bi_2O_3$)-containing non-lead amorphous frit glass for tablet use BNL188P causes no dripping. This is accounted for by the following fact. The non-lead amorphous frit glass for tablet use BNL188P exhibits larger surface tension even at the firing temperature over the softening point than adhesive 31 formed of the phosphate-tin oxide and vanadium oxide-zinc oxide-barium oxide non-lead amorphous frit glasses. As further described above, the lead-containing amorphous high-softening-point frit glass GA-0963 causes no dripping. This can be attributed to the fact that lead-containing high-softening-point frit glass starts crystallization during firing, preventing the dripping, when heated over its softening point.

As can be seen from the characteristics shown in Table 1, the bismuth oxide ($Bi_2O_3$)-containing non-lead borosilicate amorphous frit glass BNL188P composed of bismuth oxide-boron oxide glass used for the tablet for sealing the rear panel 23 and exhaust pipe 21 is about 10° C. higher in softening point than the frit glass BNL189P used for adhesive 31 applied to the peripheries of front panel 22 and rear panel 23, and almost the same in softening point as the lead-containing amorphous frit glass GA-0963. The bismuth oxide ($Bi_2O_3$)-containing non-lead borosilicate frit glasses BNL188P and BNL189P are both amorphous, and start crystallization when a firing temperature increases over the softening point. BNL188P, however, exhibits a softening point about 10° C. higher than BNL189P does. Use of BNL188P, therefore, causes no crystallization, thereby preventing dripping of adhesive 31, at the sealing temperature during the process of manufacturing PDP 20 in accordance with the preferred embodiment of the present invention. Thus, the use of BNL188P is desirable in the preferred embodiment of the present invention.

The method of manufacturing PDP 20 in accordance with the preferred embodiment of the present invention performs an exhaust process at a temperature of 410° C. after completing a sealing step. The arrangement shown in FIGS. 3A and 3B, where the open end of exhaust pipe 21 to be connected to the exhaust device faces down, causes a stress to be applied to exhaust pipe 21 from a manufacturing device. This possibly causes a displacement of exhaust pipe 21 and leakage therefrom if the fit glass used for adhesive 31 has a low softening point. Use of the non-lead amorphous frit glass BNL188P for sealing exhaust pipe 21, prevents the occurrence of such a problem because of its about 10° C. higher softening point than that of BNL189P.

As described above, PDP 20 in accordance with the preferred embodiment of the present invention can be sealed without the softened (melted) frit glass being dripped at the sealing temperature even during the sealing step performed with the arrangement where the open end of exhaust pipe 21 to be connected with the exhaust device faces down, because the high-softening-point bismuth oxide ($Bi_2O_3$)-containing non-lead borosilicate amorphous fit glass is used. The method of manufacturing PDP 20 in accordance with the preferred embodiment of the present invention, therefore, allows the sealing step to be performed without causing adhesive 31 used for sealing exhaust pipe 21 to drip to deteriorate the airtightness at exhaust pipe 21.

In the above-described method of manufacturing PDP 20 in accordance with the preferred embodiment of the present invention, adhesive 31 is placed and formed at the peripheries of front panel 22 and rear panel 23 by use of the thick film printer or the coater, as an example. However, adhesive 31 may also be formed without the thick film printer nor the coater, but may instead be formed by the following method. Adhesives are formed on sheet-like bases so as to have a specified thickness and form with adhesivity; the formed adhesives 31 are placed and bonded onto the respective portions of front panel 22 and rear panel 23; front panel 22 and rear panel 23 are assembled; and a sealing is performed.

Figure 6A:
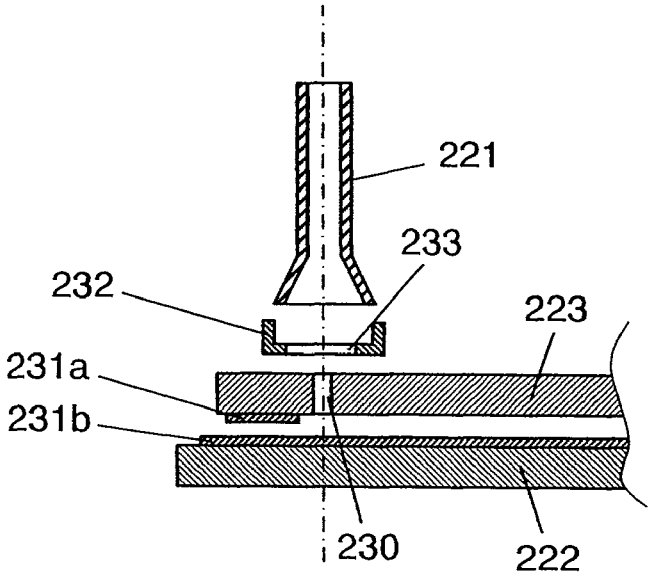
FIG. 6A PRIOR ART
FIG. 6A is a cross-sectional view schematically showing a procedure of sealing the peripheries of a front panel and a rear panel and an exhaust pipe of the PDP with adhesives in accordance with the conventional technique.
Figure 6B:
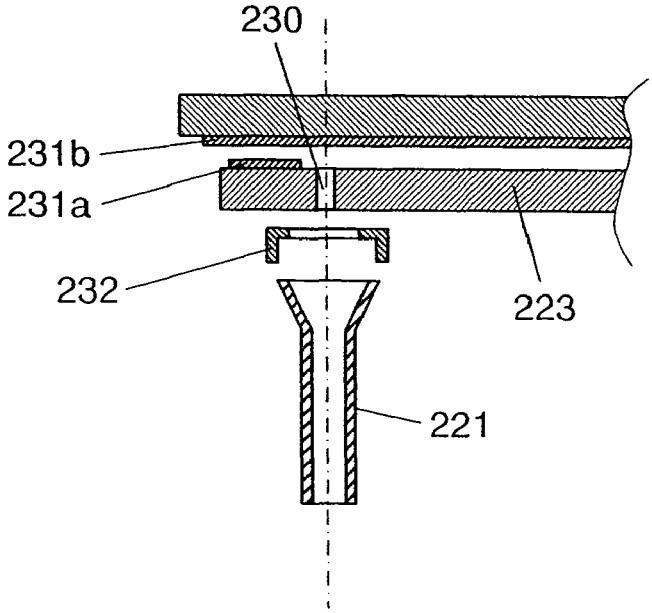
PRIOR ART FIG. 6B
FIG. 6B is a cross-sectional view schematically showing a procedure of sealing the peripheries of a front panel and a rear panel and an exhaust pipe of the PDP with adhesives in accordance with the conventional technique.

In the above-described method of manufacturing PDP 20 in accordance with the preferred embodiment of the present invention, the arrangement shown in FIGS. 3A and 3B, where the open end of exhaust pipe 21 at the side of the exhaust device faces down, is employed as an example for sealing exhaust pipe 21 with adhesive 31 formed of the bismuth oxide ($Bi_2O_3$)-containing non-lead borosilicate amorphous frit glass. Another arrangement shown in FIG. 6A, where the open end of exhaust pipe 21 at the side of the exhaust device faces up, can also be employed for sealing exhaust pipe 21 with adhesive 31 formed of the bismuth oxide ($Bi_2O_3$)-containing non-lead borosilicate frit glass.

The above-described bismuth oxide ($Bi_2O_3$)-containing non-lead borosilicate frit glass, used for the method of manufacturing PDP 20 in accordance with the preferred embodiment of the present invention, is not necessarily non-lead in a precise sense, but can usually be detected containing extremely small amount of lead not exceeding 500 PPM by analysis. However, an impurity level not exceeding 1000 PPM is deemed as non-lead under the provisions of EU Directive EC-RoHS concerning the environment. In this sense, the expression "containing no lead" or "non-lead" is used in the preferred embodiment of the present invention.

INDUSTRIAL APPLICABILITY

The present invention employs bismuth oxide ($Bi_2O_3$)-containing non-lead borosilicate frit glass having a high softening point, and thereby allows a sealing process to be performed without dripping of the softened (melted) frit glass even at a high sealing temperature. The present invention, therefore, prevents the deterioration in airtightness at the sealed portion, and improves reliability in the sealing. The present invention further provides PDPs that are environment-friendly and high in display quality, and is applicable to large-scale display devices and others.

The invention claimed is:

1. A method of manufacturing a plasma display panel, the plasma display panel including: a front panel and a rear panel positioned to face each other and sealed with an adhesive at peripheries of the front panel and the rear panel to form a discharge space therein; and an exhaust pipe for exhausting the discharge space and then filling the discharge space with a discharge gas, and the method comprising steps of:

placing a first open end of the exhaust pipe to be sealed around a fine exhaust hole disposed on the rear panel via a tablet formed of non-lead frit glass containing bismuth oxide, the non-lead frit glass having a softening point higher than the adhesive;

positioning and assembling the front panel and the rear panel facing with each other;

placing a second open end of the exhaust pipe to be connected with an exhaust device, on the exhaust device with the second open end facing down; and performing a sealing at a specified sealing temperature.

2. The method of manufacturing a plasma display panel according to claim 1, wherein the tablet is formed of frit glass including bismuth oxide-boron oxide base.

3. The method of manufacturing a plasma display panel according to claim 2, wherein the frit glass used for the tablet has a softening point about 10° C. higher than the adhesive.

* * * * *

UNITED STATES PATENT AND TRADEMARK OFFICE

CERTIFICATE OF CORRECTION

PATENT NO. : 7,922,555 B2
APPLICATION NO. : 11/816004
DATED : April 12, 2011
INVENTOR(S) : Nishinaka et al.

It is certified that error appears in the above-identified patent and that said Letters Patent is hereby corrected as shown below:

On the cover page, Item (57), please replace the Abstract with the following Abstract:

--A method of manufacturing a plasma display panel is provided. The plasma display panel includes: a front panel and a rear panel positioned to face each other sealed with an adhesive at peripheries of the front panel and the rear panel to form a discharge space therein; and an exhaust pipe for once exhausting the discharge space and then filling the discharge space with a discharge gas. The method includes steps of: placing a first open end of the exhaust pipe to be sealed around a fine exhaust hole disposed on the rear panel via a tablet formed of non-lead frit glass; positioning and assembling the front panel and the rear panel facing with each other; placing a second open end of the exhaust pipe to be connected with an exhaust device on the exhaust device with the second open end facing down; and performing a sealing at a specified sealing temperature.--

Signed and Sealed this
Sixteenth Day of August, 2011

David J. Kappos

David J. Kappos
*Director of the United States Patent and Trademark Office*